US012350782B2

(12) United States Patent
Kim et al.

(10) Patent No.: US 12,350,782 B2
(45) Date of Patent: Jul. 8, 2025

(54) METHOD FOR PRODUCING STABLE-PHASE CRYSTALS USING PHYSICAL GRINDING

(71) Applicant: University-Industry Cooperation Group of Kyung Hee University, Yongin-si (KR)

(72) Inventors: Woo Sik Kim, Suwon-si (KR); Jeong Ki Kang, Suwon-si (KR); Jinsoo Kim, Yongin-si (KR); Jinsoo Kim, Seongnam-si (KR)

(73) Assignee: University-Industry Cooperation Group of Kyung Hee University, Yongin-si (KR)

( * ) Notice: Subject to any disclaimer, the term of this patent is extended or adjusted under 35 U.S.C. 154(b) by 484 days.

(21) Appl. No.: 17/668,686

(22) Filed: Feb. 10, 2022

(65) Prior Publication Data

US 2023/0084034 A1 Mar. 16, 2023

(30) Foreign Application Priority Data

Sep. 7, 2021 (KR) ..... 10-2021-0119266

(51) Int. Cl.
*B24B 19/22* (2006.01)

(52) U.S. Cl.
CPC ..... *B24B 19/22* (2013.01)

(58) Field of Classification Search
CPC ..... C30B 35/007; B24B 1/00
See application file for complete search history.

(56) References Cited

U.S. PATENT DOCUMENTS

2003/0096013 A1* 5/2003 Werling ..... A61K 9/145 424/489
2006/0280430 A1* 12/2006 Rabinow ..... A61K 9/0085 386/281
2015/0125535 A1* 5/2015 Enlow ..... A61P 35/00 424/490

FOREIGN PATENT DOCUMENTS

CN 102949379 A * 3/2013 ..... A61K 9/72
CN 111848428 A * 10/2020 ..... C07C 227/42
JP 09003015 A 1/1997
JP 2018-21262 A 2/2018
KR 10-2013-0084433 A 7/2013
KR 20130084433 * 7/2013 ..... C07C 231/22

OTHER PUBLICATIONS

English computer translation of CN 102949379 (Year: 2024).*
English computer translation of CN 111848428 (Year: 2024).*
English computer translation of KR 20130084433 (Year: 2024).*
Chen, F. et al. "Synthesis of gamma-Phase and Amorphous Solid Dispersion of Glycine from alpha-Glycine During the Solvent-Free Ball Milling Process" Journal of Pharmaceutical Sciences, Jun. 14, 2021, vol. 110, 9, p. 3171-3175.

(Continued)

*Primary Examiner* — Matthew J Song
(74) *Attorney, Agent, or Firm* — Westman, Champlin & Koehler, P.A.; Amanda M. Prose

(57) ABSTRACT

The present disclosure relates to a method for producing stable phase crystals using physical grinding, and specifically, to a method for efficiently and stably phase-transforming a metastable phase crystal into a stable phase crystal without using chemicals such as additives for promoting the phase transformation from the metastable phase crystal into the stable phase crystal.

3 Claims, 2 Drawing Sheets

(56) References Cited

OTHER PUBLICATIONS

Office Action issued for KR patent application serial No. 10-2021-0119266, dated Oct. 27, 2022, with English machine translation.
Notice of Allowance issued in KR patent application serial No. 10-2021-0119266, dated Jan. 13, 2023, with English machine translation.

* cited by examiner

[Fig. 1]
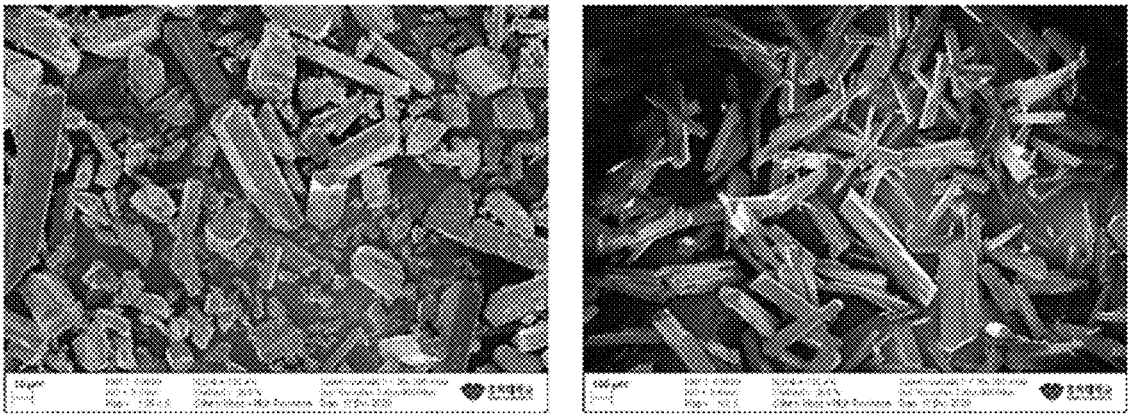
(a) (b)
[Fig. 2]
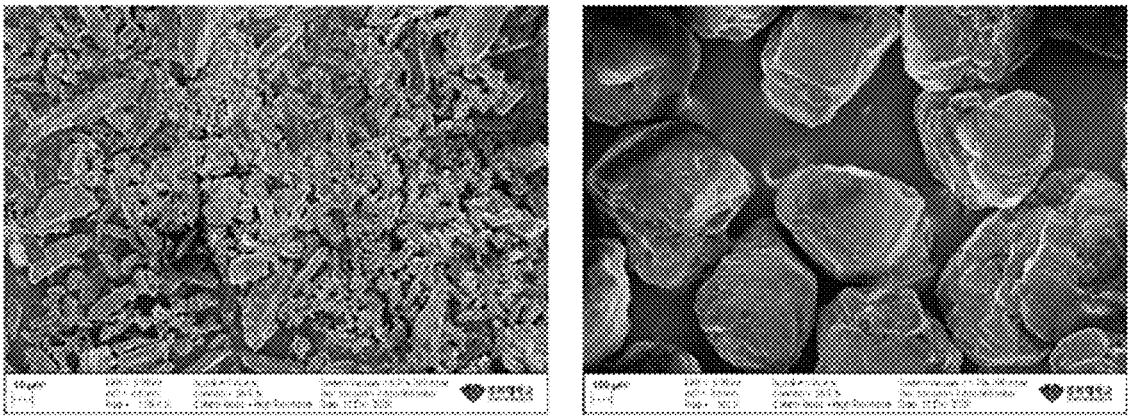
(a) (b)

[Fig. 3]
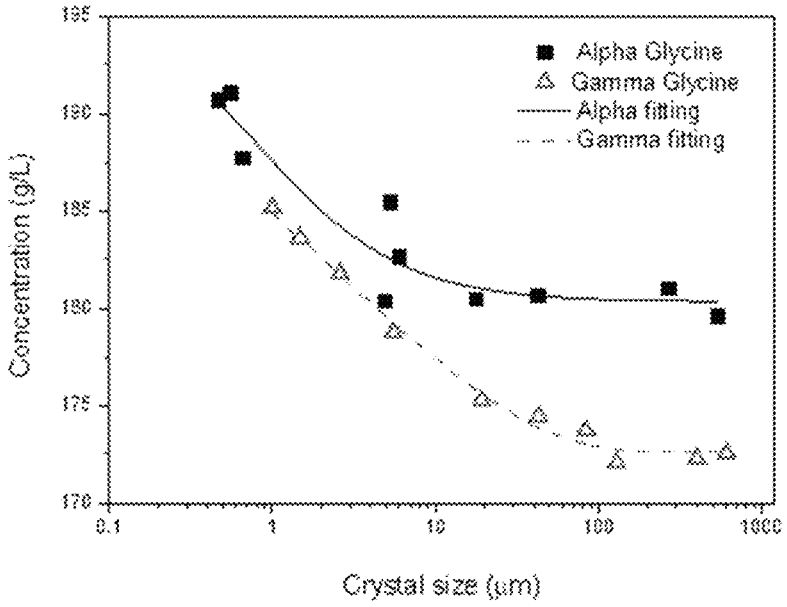
[Fig. 4]
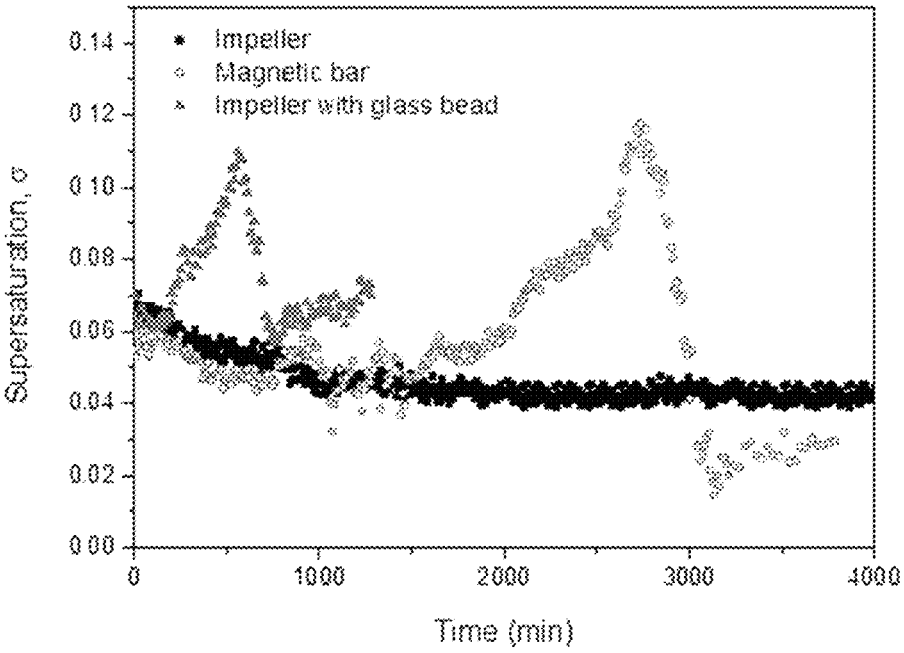

METHOD FOR PRODUCING STABLE-PHASE CRYSTALS USING PHYSICAL GRINDING

CROSS-REFERENCE TO RELATED APPLICATION

This application claims priority to Korean Patent Application No. 10-2021-0119266, filed on Sep. 7, 2021, the disclosure of which is incorporated by reference herein in its entirety.

BACKGROUND OF THE DISCLOSURE

Field of the Disclosure

The present disclosure relates to a method for easily and quickly precipitating a metastable phase crystal having a difficulty in phase transformation into a stable phase using a physical grinding technique, and to a stable phase crystal produced using the same.

Related Art

Crystallization technology is a technology frequently used in separation and purification and material manufacturing processes in the chemical industry. Recently, thanks to the development of precision measuring equipment, crystallization phenomena at a molecular level can be identified, and technology research that can control the crystallization process at the molecular level is of great interest around the world. Many studies are being attempted to actively utilize these recent crystallization technologies for high value added activities of not only conventional general-purpose chemicals but also fine chemicals and pharmaceutical materials.

Crystal polymorph refers to the appearance of the same material as crystals with different structures during a crystallization process. In the crystal structure, a crystal with a high energy level is called a metastable phase crystal, a crystal with a low energy level is called a stable phase crystal, and a change from a metastable phase crystal into a stable phase crystal is called a phase transformation.

In general, the crystallization process is the precipitation of solid crystals from a supersaturated solution. In this connection, the metastable phase crystals are first precipitated by Ostwald's Rule of Stage, and then the metastable phase crystals are re-precipitated as stable phase crystals through a phase transformation. However, the metastable phase transformation is often very difficult, and in this case, it becomes very difficult to obtain a stable phase crystal. In order to promote such a phase transformation, a method of promoting the phase transformation by adding an additive (a salt-based compound) or other solvent is often used. However, in this method, additives or additional solvents may remain as impurities in the crystal, which may harm the human body or the crystal compound.

SUMMARY OF THE DISCLOSURE

An aspect of the present disclosure is directed to providing a method for efficiently and stably phase-transforming a metastable phase crystal into a stable phase crystal without using chemicals such as additives for promoting the phase transformation.

Another aspect of the present disclosure is directed to providing a stable phase crystal having high purity and high stability in which additional chemicals are not used for phase transformation into the stable phase crystal during the production process.

A method for producing a stable phase crystal according to an aspect of the present disclosure includes a physical grinding process of a metastable phase crystal.

The metastable phase crystal may be an organic crystal.

The organic crystal may be at least one selected from the group consisting of glycine, L-histidine, carbamazepine, and omeprazole.

The metastable phase crystal may be precipitated from a supersaturated solution.

In the physical grinding process, a grain size of the metastable phase crystal may be ground to 1 μm or less, and the metastable phase crystal may be ground using inert solid grains.

Examples of inert solid grains include at least one selected from the group consisting of glass beads, iron beads, zirconia beads, stainless beads, Hot Isostatic Press (HIP) processed beads, yttrium beads, and cerium beads, wherein a size of the inert solid grain may be 1 mm to 10 mm.

The physical grinding process may specifically be a process of grinding metastable phase crystals by rotating the inert solid grains having a size of 1 mm to 3 mm at 200 to 300 rpm for 24 to 48 hours.

A stable phase crystal according to another aspect of the present disclosure is produced according to the aforementioned production method.

The method for producing a stable phase crystal according to an aspect of the present disclosure enables easy phase-transformation of a metastable phase crystal into a stable phase crystal only by physical grinding of the crystal without using additional additives or other component compounds such as a solvent.

Accordingly, it may be a particularly suitable method for phase transformation from metastable phase crystals to stable phase crystals in fields requiring high product purity, such as fine chemistry or pharmaceutical fields.

BRIEF DESCRIPTION OF THE DRAWINGS

FIG. 1 is scanning electron microscope (SEM) images of metastable phase alpha-glycine crystals.

FIG. 2 is SEM images of stable phase gamma-glycine crystals.

FIG. 3 shows the solubility according to the crystal size of the metastable phase alpha-glycine and the stable phase gamma-glycine.

FIG. 4 shows the degree of supersaturation of a stable phase according to a stirring time, and compares the phase transformation from a metastable phase to a stable phase according to a stirring method.

DESCRIPTION OF EXEMPLARY EMBODIMENTS

Hereinafter, the present disclosure will be described in detail with reference to the drawings.

Prior to the description, it should be understood that the terms used in the specification and the appended claims should not be construed as limited to general and dictionary meanings, but interpreted based on the meanings and concepts corresponding to technical ideas of the present disclosure on the basis of the principle that the inventor is allowed to define terms appropriately for the best explanation.

Accordingly, the embodiments described in the specification and the configurations illustrated in the drawings are merely the most preferable embodiments of the present disclosure and should not be construed as representing all the technical ideas of the present disclosure. It should be understood that there may be various equivalents and variations that replace these embodiments at the time of filing this application.

The method for producing a stable phase crystal according to an aspect of the present disclosure is related to a method for producing a stable phase crystal, wherein the method includes phase-transforming a metastable phase crystal into a stable phase crystal using only a physical grinding process without adding an additional compound for phase transformation. The physical grinding is a concept that includes not only the meaning of merely splitting grains, but also the process of making a grain size smaller by polishing a grain surface.

The metastable phase crystal may be specifically an organic crystal, and may be effective in phase transforming a metastable phase organic crystal synthesized in the fields of fine chemical products, food additives, or raw material medicine, which is a field sensitive to the presence of the chemical additives, into a stable phase organic crystal.

In particular, the method for producing the stable phase crystal enables phase transformation of a metastable phase crystal having a difficulty in phase transformation into a stable phase without an additional additive for phase transformation. The metastable phase crystal having a difficulty in phase transformation into a stable phase crystal includes, for example, glycine, L-histidine, carbamazepine and omeprazole, and raw material medicine such as glutamic acid, food additives, and fine chemical products may be applied.

The metastable phase crystal may be precipitated from a supersaturated solution, and specifically, may exist in a solid phase in a solvent. The metastable phase crystal is a metastable phase crystal that is precipitated before a stable phase crystal in a supersaturated solution according to Ostwald's Rule of Stage, and is a metastable phase crystal that thermodynamically undergoes a phase transformation into a stable phase with a low energy level, but has not yet undergone a phase transformation into a stable phase because the reaction rate is very slow.

The metastable phase crystal, which has not undergone a phase transformation due to the reaction rate problem, may promote the phase transformation by reducing the grain size of the crystal through a physical grinding process through wear. When the crystal grains are made smaller according to the Ostwald-Freundlich equation, the solubility of the crystal grains increases. Accordingly, the solubility of metastable phase crystal grains with a smaller grain size by physical grinding increases, thereby promoting a phase transformation into a stable phase. In order for the metastable phase crystal to easily undergo a phase transformation into the stable phase crystal, it is preferable to grind the grain size of the metastable phase crystal to 1 μm or less. When the grain size of the metastable phase crystal is ground to less than 700 nm, a phase transformation into the stable phase may be further promoted.

A method of physically grinding metastable phase crystals is not particularly limited as long as it is a method of grinding grains using an external physical force. In the physical grinding process, for example, inert solid grains may be used, or a homogenizer or wet milling apparatus may be used. The physical grinding process of the homogenizer may be a process of grinding metastable phase crystals while rotating preferably at about 3,000 to 25,000 rpm for a predetermined time. In addition, the physical grinding process using the wet milling may be a grinding process by circulating equipment equipped with a rotor-stator having a shear frequency (1/s) of about 20,000 to 80,000 for 500 cycles or more. However, in the process of physically grinding metastable phase crystals, it may be effective to use inert solid grains. Specifically, in the process of rotating or vibrating the inert solid grains together with the metastable phase crystal and the solvent, the inert solid grains and the metastable phase crystal may collide and the metastable phase crystal may be ground.

The inert solid grains refer to solid grains that do not chemically react with the solvent, metastable phase crystals and stable phase crystals. In order to grind the metastable phase crystals through physical collision, it is preferable that the inert solid grains are formed with a stronger bond than the metastable phase crystals and are hard materials. Examples of inert solid grains include glass beads, iron beads, zirconia beads, stainless beads, Hot Isostatic Press (HIP) processed beads, yttrium beads, and cerium beads, but it is not limited to the above example, and the solid grains do not necessarily have to have a spherical shape, either.

In order to grind the metastable phase crystal, the size of the inert solid grains is not particularly limited, but it may be preferable to use the inert solid grains having a size of 1 mm to 10 mm for effective grinding, and more preferably 1 mm to 3 mm in diameter. For example, spherical beads having a size of 1.7 to 2.0 mm may be used. When the inert solid grains are spherical, the size of the solid grains means a diameter. When the size of the inert solid grains for grinding the metastable phase crystals is smaller than 1 mm, it may be difficult to give an effective physical impact to the metastable phase crystals, and thus the grinding efficiency of the metastable phase crystals may decrease. In addition, when the size of the inert solid grains is greater than 10 mm, it may be difficult to finely grind the metastable phase crystals so that the metastable phase may undergo a phase transformation into the stable phase. Preferably, when the size of the inert solid grains is 3 mm or less, the size of the metastable phase crystal may be more easily ground to 1 μm.

In the physical grinding method, for example, the inert solid grains, the solvent, and the metastable phase crystals may be rotated together at 100 to 500 rpm for 1 hour to 50 hours, and the metastable phase crystals may be ground to perform re-precipitation through phase transformation into a stable phase. The smaller the size of the inert solid grains used, the faster the stirring speed, the shorter the grinding time may be. In an embodiment of the present disclosure, when the size of the inert solid grains is 1 mm to 3 mm, the metastable phase crystal may be ground by rotating the same at 200 to 300 rpm for 24 to 48 hours.

The stable phase crystal according to another aspect of the present disclosure is a stable phase crystal produced by phase transformation from a metastable phase crystal using the physical grinding process, and is a stable phase crystal having high purity and improved stability because a separate solvent or compound is not added for the phase transformation.

Hereinafter, embodiments of the present disclosure will be described in detail so that those having ordinary skill in the technical field to which the present disclosure pertains can easily carry out the present disclosure. However, the present disclosure may be embodied in various different forms and is not limited to the embodiments described herein.

EXAMPLES: PRODUCTION OF STABLE PHASE CRYSTALS USING PHYSICAL GRINDING

An alpha-glycine crystal, which is a representative metastable phase crystal material that does not easily undergo a phase transformation to a stable phase crystal, was subjected to a phase transformation in the following manner to produce a gamma-glycine crystal, which is a stable phase crystal material.

Example 1: Production of Stable Phase Crystals Using Glass Beads

Purified water was used as the solvent, and glass beads having a radius of 1.7 to 2.0 mm were used as the inert solid grains. The stable phase crystals were produced by stirring the solvent, glass beads, and alpha-glycine crystals, which are metastable phase crystals.

To produce gamma-glycine crystals, which are stable phase crystals, about 250 g of metastable phase crystals, alpha-glycine, were added to 1 L of water cooled to 10° C. A portion of alpha-glycine was dissolved in water to exist as a solution, and the remaining undissolved alpha-glycine remained in the solution as a suspension. In addition, the glass beads weighing about 50 g and having a diameter of 1.7 mm to 2.0 mm were added and stirred using a propeller stirring device. The stirring speed was adjusted to 300 rpm and stirred. After 10 hours, about 10 mL of a sample was collected, filtered, dried, and subjected to XRD analysis. By checking the XRD pattern, it was identified that gamma-glycine crystals, which are stable phase crystals, were generated. When the XRD pattern of the metastable phase alpha-glycine crystals was identified together, a sample was taken every hour and XRD analysis was performed to identify that all the metastable phase alpha-glycine crystals had disappeared, and then the experiment was completed.

Example 2: Production of Stable Phase Crystals Using Zirconia Beads

A double-jacketed reactor with a temperature control device and glass inner volume of 1.5 L was prepared. A clear aqueous solution in which about 270 g of glycine was dissolved in 1 L of distilled water at a temperature of 50° C. was prepared and was filled in the reactor. The solution was cooled to 10° C. and cooled crystallization was performed. In this case, the inside of the reactor was stirred using a propeller stirring device. The stirring speed was adjusted to 300 rpm and stirred. During cooling to 10° C., metastable phase alpha-glycine grains were precipitated in a clear solution. When the temperature reached 10° C., 100 g of zirconia beads weighing about 70 g and having a diameter of 1.5 mm to 3.0 mm were added while maintaining the temperature at 10° C., and stirring was continued. After 15 hours, about 10 mL of a sample was collected, filtered, and dried for XRD analysis. By checking the XRD pattern, it was identified that gamma-glycine crystals, which are stable phase crystals, were generated. When the XRD pattern of the metastable phase alpha-glycine crystals was identified together, a sample was taken every hour and XRD analysis was performed to identify that all the metastable phase alpha-glycine crystals had disappeared, and then the experiment was completed.

Experimental Example 1: Measurement of Solubility According to Crystal Grain Size In order to measure the solubility according to the crystal grain size, alpha-glycine crystals were separated into 6 grain size groups as shown in Table 1 below using a sieve and a sieve shaker.

TABLE 1

| Alpha-glycine (μm) | Group 1 | Group 2 | Group 3 | Group 4 | Group 5 | Group 6 |
|---|---|---|---|---|---|---|
| Dv(10) | 4.9 | 6.0 | 17.8 | 42.8 | 270 | 537 |
| Dv(50) | 20.6 | 35.8 | 46.9 | 129 | 509 | 921 |
| Dv(90) | 53.4 | 97.8 | 121 | 306 | 900 | 1810 |

FIG. 1A is a scanning electron microscope (SEM) image of the alpha-glycine group 2 of Table 1 above, and FIG. 1B is an SEM image of the alpha-glycine group 5 of Table 1 above.

In addition, in order to measure the solubility of gamma-glycine crystals according to the grain size, gamma-glycine crystals were separated into 6 grain size groups as shown in Table 2 below using a sieve and a sieve shaker.

TABLE 2

| Gamma-glycine (μm) | Group 1 | Group 2 | Group 3 | Group 4 | Group 5 | Group 6 |
|---|---|---|---|---|---|---|
| Dv(10) | 5.5 | 19.2 | 43.0 | 129 | 269 | 610 |
| Dv(50) | 19.7 | 168 | 210 | 312 | 432 | 757 |
| Dv(90) | 97.8 | 394 | 420 | 540 | 641 | 943 |

FIG. 2A is a scanning electron microscope (SEM) image of the gamma-glycine group 1 of Table 2 above, and FIG. 2B is an SEM image of the gamma-glycine group 6 of Table 2 above.

When calculating the average grain converted into the number of grains in each group above, Dv(10) occupies a specific gravity of about 95% or more, determines a surface area of the grain population, and is the factor that has the greatest influence on the solubility of grains. FIG. 3 shows the measurement of solubility according to grain size with Dv(10) as a value representing the grain size group.

Referring to the solubility result of FIG. 3, it was identified that the solubility of alpha-glycine gradually increased as the grain size thereof decreased. It was identified that when the grain size was about 3 μm or less, the solubility increased rapidly, and the solubility increased from about 180 to 190 g/L. Similarly to alpha-glycine, also in gamma-glycine, it was identified that solubility increased as the grain size decreased.

Experimental Example 2: Comparison of Stable Phase Crystal Precipitation Rate According to Physical Grinding FIG. 4 illustrates supersaturation of stable phase crystals according to stirring time of a simple propeller stirring device (Impeller, Comparative Example 1), a propeller stirring device including a magnetic bar (Magnetic bar, Example 1), and a propeller stirring device including glass beads (Impeller with glass beads, Example 2).

Referring to the Impeller of FIG. 4, without physical grinding, 300 g of each of the alpha-glycine group 1 to group 6 samples shown in Table 1 were put into a simple propeller stirrer and stirred at 300 rpm for about 15 days, but a phase transformation into gamma-glycine, which is a stable phase crystal, could not be found. Thus, it was identified that when only a simple propeller stirring device was used, the stable phase crystal (gamma-glycine) precipitation rate was 0% for all samples of the six groups.

Referring to the magnetic bar in FIG. 4, when the magnetic bar was stirred with alpha-glycine in a propeller stirring device at 300 rpm, the supersaturation of the stable phase crystals (gamma-glycine) increased after about 1,500 minutes. When the magnetic bar was stirred/ground for about 65 hours or more (6,800 minutes), 100% of stable phase crystals could be obtained.

In addition, referring to the impeller with glass beads of FIG. 4, when the glass beads having a diameter of about 1.7 to 2.0 mm were added to the simple propeller stirring device in an amount of about 100 to 200 g and stirred/pulverized at 300 rpm, it was observed that alpha-glycine of the samples of groups 1 to 6 shown in Table 1 was ground very quickly, and the supersaturation of stable phase gamma-glycine rapidly increased. When the glass beads were stirred/ground for 24-48 hours, 100% of gamma-glycine, which is a stable phase crystal, could be obtained.

Experimental Example 3: Comparison of Phase Transformation Rate According to Physical Grinding Method Using 100 g of glass beads having a diameter of about 1.7 to 2.0 mm, 300 g of alpha-glycine of group 1 of Table 1 was stirred at 500 rpm to perform physical grinding. After 24 hours from the start of the stirring, it was identified that the alpha-glycine of the sample of group 1 was 100% phase-transformed into gamma-glycine.

Using zirconia beads having a diameter of about 5.0 to 7.0 mm, 300 g of alpha-glycine of group 1 of Table 1 was stirred at 100 rpm to perform physical grinding. After 24 hours from the start of the stirring, it was identified that the alpha-glycine of the sample of group 1 was 0% phase-transformed into gamma-glycine. However, it was identified that 100% of the phase transformation from alpha-glycine to gamma-glycine, which is a stable phase, was achieved when the zirconia beads was further stirred for 48 hours thereafter.

Hereinbefore, although the embodiments of the present disclosure have been described in detail, the scope of right of the present disclosure is not limited thereto, and it will be apparent to those of ordinary skill in the art that various modifications and variations are possible within the scope without departing from the technical spirit of the present disclosure described in the claims.

What is claimed is:

1. A method for producing a stable phase crystal, the method including a physical grinding process of a metastable phase crystal without adding an additional compound for promoting phase transformation, wherein the metastable phase crystal is an organic crystal of glycine, which is precipitated from a supersaturated solution, wherein the physical grinding process is to grind the metastable phase crystals by rotating inert solid grains at 200 to 300 rpm for 24 to 48 hours, and wherein a size of the inert solid grain is 1.7 mm to 2 mm.

2. The method of claim 1, wherein in the physical grinding process, a grain size of the metastable phase crystal is ground to 1 μm or less.

3. The method of claim 1, wherein the inert solid grains include at least one selected from the group consisting of glass beads, iron beads, zirconia beads, stainless beads, Hot Isostatic Press (HIP) processed beads, yttrium beads, and cerium beads.

* * * * *